US007124465B1

(12) United States Patent
Kaminstein

(10) Patent No.: US 7,124,465 B1
(45) Date of Patent: Oct. 24, 2006

(54) MULTI-LAYERED HANGING CLEANING SPONGE

(75) Inventor: Bruce Kaminstein, Blauvelt, NY (US)

(73) Assignee: Kaminstein Imports, Inc., Blauvelt, NY (US)

( * ) Notice: Subject to any disclaimer, the term of this patent is extended or adjusted under 35 U.S.C. 154(b) by 617 days.

(21) Appl. No.: 09/662,857

(22) Filed: Sep. 15, 2000

(51) Int. Cl.
*A47L 13/16* (2006.01)

(52) U.S. Cl. ..... 15/244.3; 15/118; 15/244.4; D32/40; D32/42; D32/43

(58) Field of Classification Search ..... 15/104.04, 15/104.92, 118, 209.1, 210.1, 218, 218.1, 15/220.4, 229.11, 244.1, 244.3, 244.4; 401/289; D4/137; D28/63; D32/35, 40, 42, 43
See application file for complete search history.

(56) References Cited

U.S. PATENT DOCUMENTS

| | | | | | |
|---|---|---|---|---|---|
| 2,253,269 | A | * | 8/1941 | Gaddis | 15/220.4 |
| 2,601,771 | A | | 7/1952 | Cameron | 66/170 |
| 2,700,787 | A | * | 2/1955 | Trapanese | 15/210.1 X |
| D182,116 | S | * | 2/1958 | Gray | D32/43 |
| 3,021,649 | A | * | 2/1962 | Robbins | 15/118 X |
| 3,317,944 | A | * | 5/1967 | Napier, Sr. et al. | 15/244.1 |
| D216,276 | S | | 12/1969 | Smith et al. | D32/40 |
| 3,694,845 | A | | 10/1972 | Engelsher | 15/244.4 |
| D242,838 | S | | 12/1976 | Vilsack | D32/40 |
| 4,475,836 | A | | 10/1984 | Colognori | 401/201 |
| 4,517,702 | A | * | 5/1985 | Jackson | 15/244.4 X |
| 4,615,066 | A | | 10/1986 | Colognori | 15/244.1 |
| 4,893,369 | A | | 1/1990 | Johnson | 15/119.2 |
| 4,953,999 | A | * | 9/1990 | Rivers | 15/244.1 X |
| 5,018,237 | A | | 5/1991 | Valley | 15/244.1 |
| 5,070,552 | A | | 12/1991 | Gentry et al. | 4/615 |
| D340,558 | S | | 10/1993 | Winters | D32/40 |
| 5,311,635 | A | | 5/1994 | Moore | 15/244.3 |
| D349,592 | S | | 8/1994 | Stoll | D32/46 |
| D353,238 | S | * | 12/1994 | Francis | D32/42 |
| D355,513 | S | | 2/1995 | Posenauer | D32/40 |
| 5,640,737 | A | * | 6/1997 | Boggs | 15/118 |
| D396,907 | S | | 8/1998 | Donnelly | D32/43 |
| 5,791,008 | A | | 8/1998 | Crabtree | 15/244.1 |

FOREIGN PATENT DOCUMENTS

| | | | | |
|---|---|---|---|---|
| DE | 838 491 | | 5/1952 | |
| SE | 155359 | * | 7/1956 | 401/289 |

* cited by examiner

*Primary Examiner*—Mark Spisich
(74) *Attorney, Agent, or Firm*—Stephen E. Feldman

(57) ABSTRACT

The present invention is directed to a cleaning sponge. The cleaning sponge contains a cavity that is cut radially inward through one of the sides of the sponge. The cavity is located closer to the side of the sponge rather than its center. Furthermore, the sponge has two holding arms that are formed when the cavity is cut and form a channel, allowing the sponge to be placed on a faucet or any other hanging member. The holding arms pull apart when the sponge is placed on a faucet and once the sponge is on the faucet, they pull together. Since the cavity is near the side of the sponge, the holding arms do not interfere with the cleaning function of the sponge. Furthermore, the sponge has several layers with different coefficients of coarseness for cleaning different surfaces and may be cut in any decorative shape desired.

16 Claims, 4 Drawing Sheets

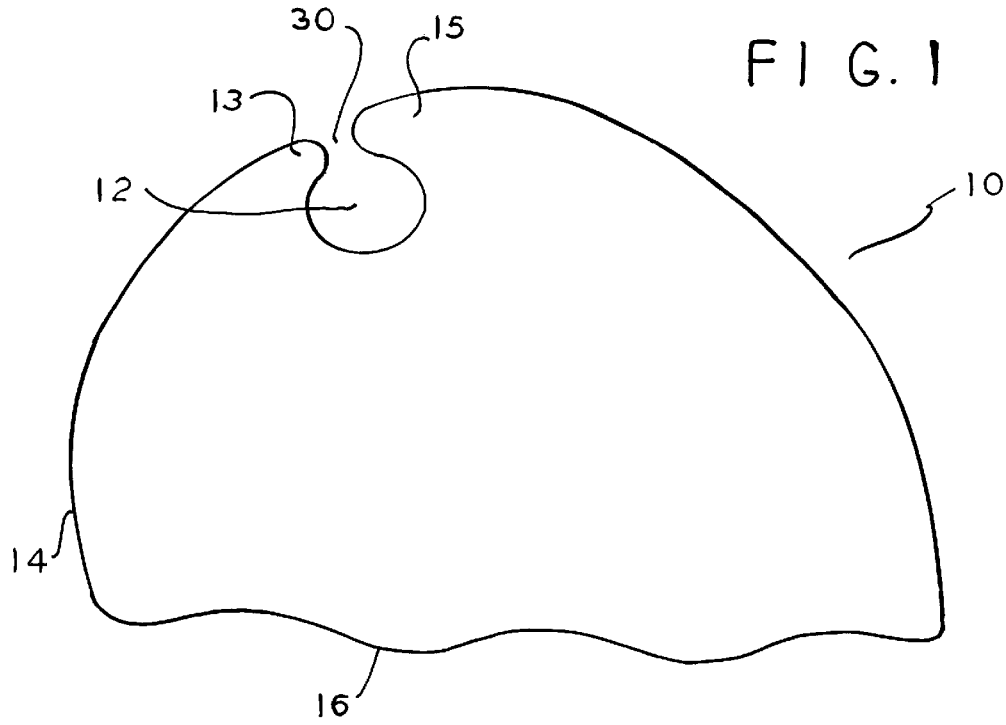
FIG. 1
FIG. 2
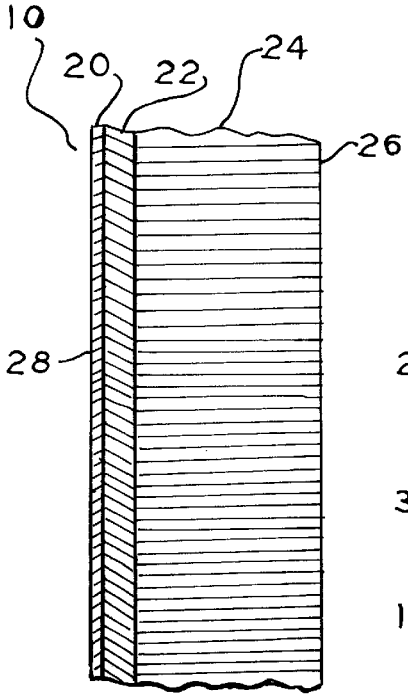
FIG. 3
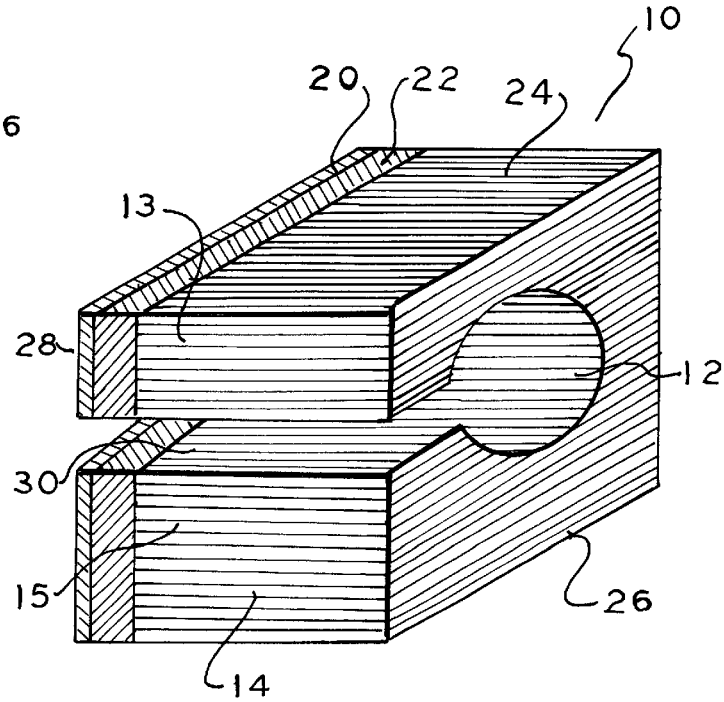

FIG. 6
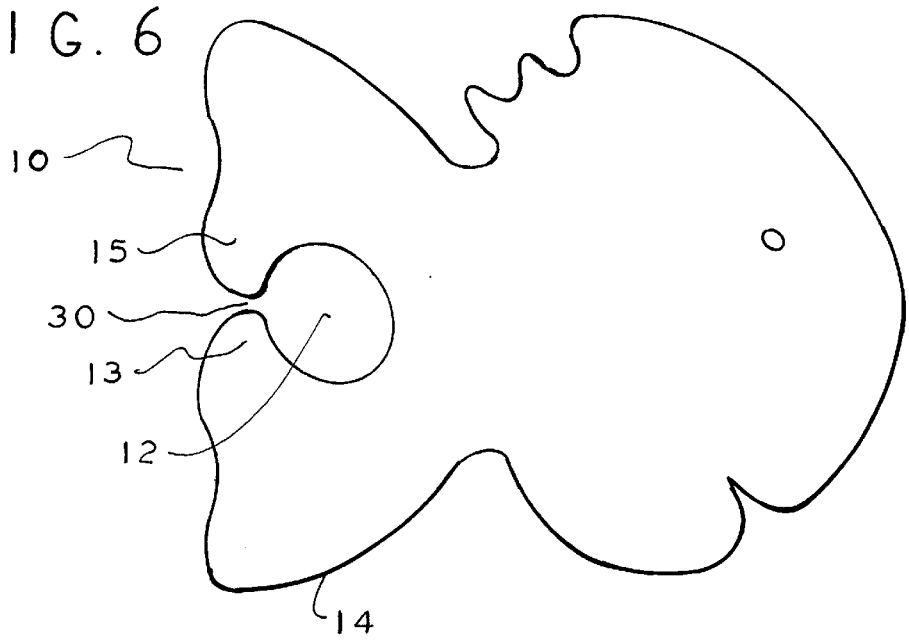
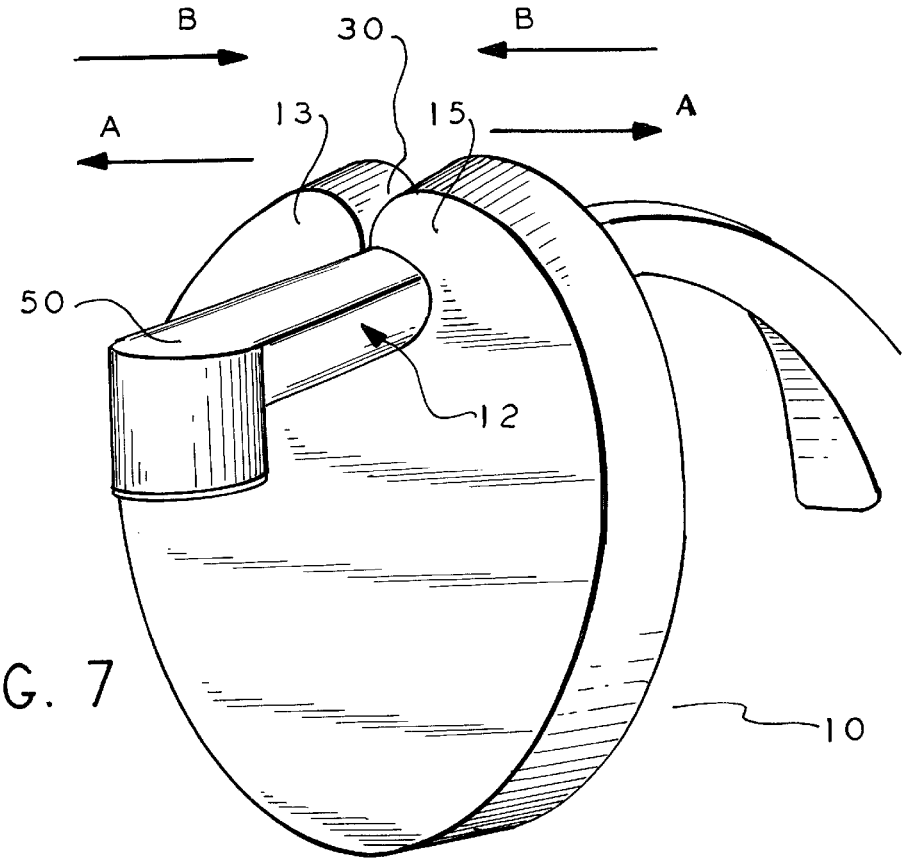
FIG. 7

MULTI-LAYERED HANGING CLEANING SPONGE

FIELD OF INVENTION

The present invention is directed towards a cleaning sponge. Specifically, the present invention discloses a multi-layered cleaning sponge, having a top layer and a bottom layer with an absorption layer in between the two, and a faucet adjustable hanger port capable of being slid on to the faucet.

BACKGROUND OF THE INVENTION

There are many well-known cleaning sponges available on the market. The prior art discloses many different alternatives for having a cleaning sponge. However, there is a long felt but unfulfilled need for having a better cleaning sponge that the prior art does not accomplish. The conventionally known prior art discloses a variety of cleaning sponges such as sponges having adjustable flaps for better cleaning, axially cut through holes for cleaning of oil sticks. Also, the prior art discloses sponges that can be hanged on a hanger, but not on the faucet. Moreover, the prior art discloses decorative sponges. The present invention supercedes all of prior art by providing features that are novel, useful and non-obvious to one skilled in the art.

In the description of the present invention, specific terms and references to the drawings are used to better describe and illustrate the present invention. However, one skilled in the art must understand that the present invention is not limited to the descriptions, illustrations and the specific terms presented in the description. The present invention is hereby limited by the prior art and the claims herewith appended. The illustrations, specific terms and descriptions are used for the purposes of presentation, description, illustration and better understanding of the present invention.

There are several U.S. Patents currently available, however, none of them address the long felt need that the present invention fulfills. The following is a brief summary of that prior art.

U.S. Pat. No. 5,018,237 to Valley teaches a dipstick wipe-off tool. The dipstick wipe-off tool comprises an absorbent body having an elongated open hole that extends axially throughout the body of the wipe-off tool. Moreover, the body of the wipe-off tool is being squeezed. The present invention comprises an absorbent sponge comprising several layers with different coefficients of coarseness and a faucet adjustable hole being cut through one side of the sponge's body. Moreover, the body of the sponge may be cut in a way for better gripping of the sponge and giving the sponge a decorative appearance.

U.S. Pat. No. 5,791,008 to Crabtree teaches a sponge having a hand grasp. The sponge comprises several layers where one layer comprises a grasp in the form of two flaps securely attached on top of the sponge. The flaps appear in the form of butterfly wings and are able to be pulled in contact with each other for better gripping of the sponge. Moreover, the sponge has a hanger port that comprises a hole being cut through the sponge. The present invention comprises a multi-layered sponge with different coefficients of coarseness and an absorption layer in between. The present invention does not have butterfly grasp handles, but has a border that is cut so that it provides for better gripping of the sponge. Moreover, the present invention provides a hanger port that is cut so that the sponge may be slid on and off a faucet without any difficulty and once the sponge is on the faucet it is able to hold on the faucet without falling from it.

U.S. Pat. No. Des. 349,592 to Stoll discloses a scraper having a hanger port that is drilled through the scraper at its top. Conversely, the present invention is a sponge with several levels of different coefficients of coarseness having a faucet adjustable hanger port.

U.S. Pat. No. Des. 353,513 to Posenauer teaches a tubing and scraping tool comprising a fork-like scraping edges and a hanger port drilled at its top. The present invention, on the other hand, is a cleaning sponge having multiple layers and a faucet hanger port.

U.S. Pat. No. Des. 396,907 to Donnelly discloses an ornamental sink spray sponge attachment. This sponge attachment is a decoratively cut sponge that has a hold in its center, so that it can be hung on a hook or any other hanging means. The present invention is directed towards a sponge that has multiple layers with different coefficients of coarseness. Moreover, the present invention has a faucet adjustable hanger port that is able to be slid on to the faucet.

While the prior art is of a significant interest, it does not address the specific need that the present invention accomplishes. The present invention provides a convenient way of having a sponge with a top layer being the coarsest and the bottom layer being the least coarse. The sponge also contains an absorption layer that is located in between the top and bottom layer. Furthermore, the sponge has an opening that is cut through one of its sides making it possible for a sponge to be slid on to a faucet.

SUMMARY OF THE INVENTION

The present invention is directed to a cleaning sponge having a multi-layered arrangement with each layer having a different coefficients of coarseness.

Another object of the present invention is to provide a cleaning sponge with a faucet adjustable hanger port.

Another object of the present invention is to provide a cleaning sponge having a decorative border.

BRIEF DESCRIPTION OF THE DRAWINGS

FIG. 1 is a plan view of the present invention showing a faucet adjustable hanger port.

FIG. 2. is a perspective view of the present invention in FIG. 1, where different layers are shown.

FIG. 3 is a perspective view of a part of the present invention in FIG. 1, showing a faucet adjustable hanger port.

FIG. 6. is a plan view of the present invention in another embodiment.

FIG. 7 is a perspective view of the present invention on the faucet.

DETAILED DESCRIPTION OF THE INVENTION

Figure 4:
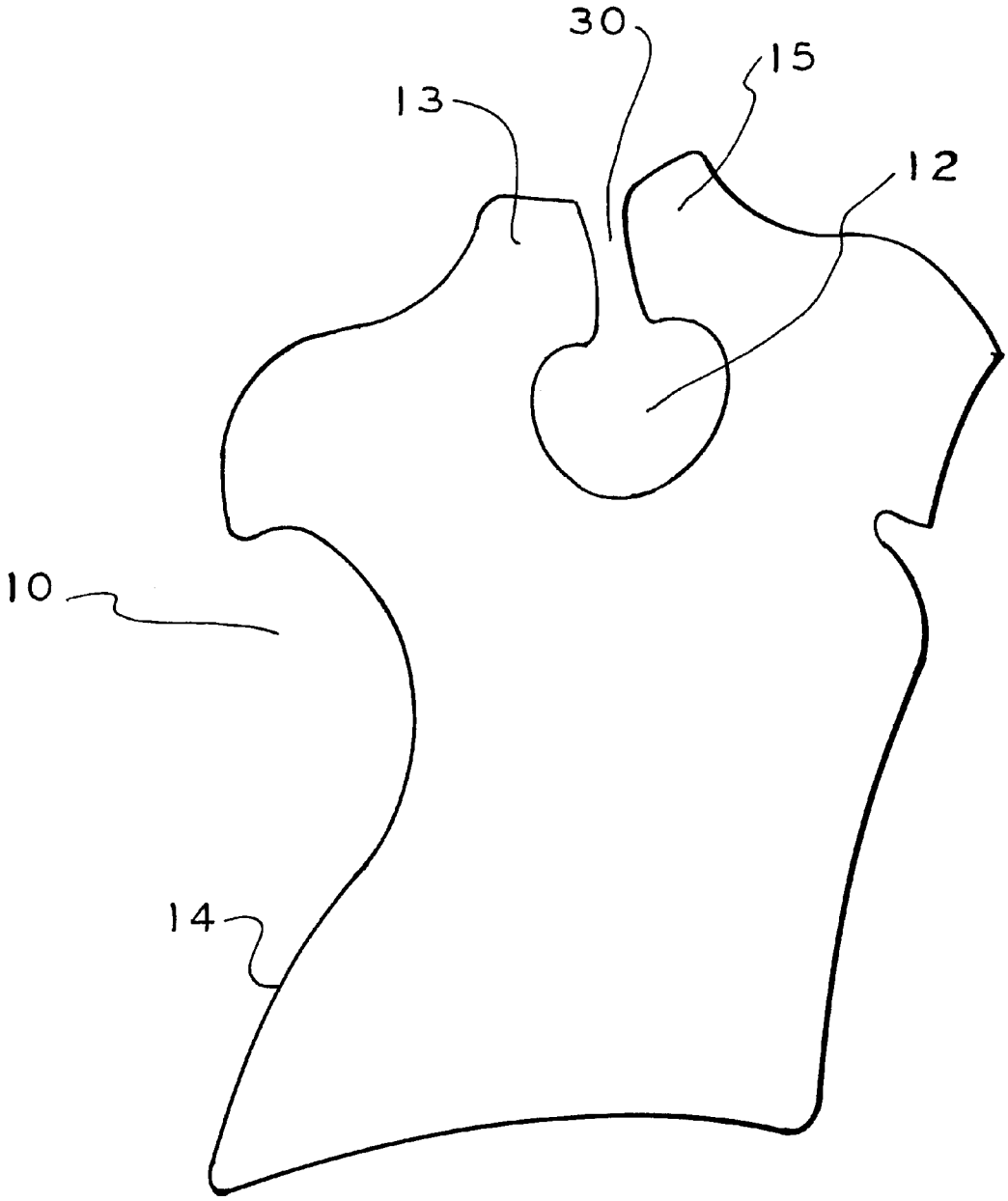
FIG. 4 is a plan view of the present invention in another embodiment.

The present invention relates to a cleaning sponge having a top level and a bottom layer and an absorption-cushion layer in between the two. Moreover, the sponge contains a faucet adjustable hanger port that is cut through all the layers forming a hollow cylindrical cavity and a faucet channel that connects the cavity with an edge surface.

Referring to FIGS. 1 through 3, the present invention is shown in various arrangements. In FIG. 1, a cleaning sponge 10 is shown having a faucet adjustable hanger port 12, a faucet channel 30 with two holding arms 13 and 15. The cleaning sponge 10 has an edge 14 through which the channel 30 and a hanger port 12 are cut. By having the hanger port 12 cut through the edge 14 of the cleaning sponge 10, the two holding arms 13 and 15 are formed. The holding arms 13 and 15 are elastic and, therefore, capable of being pulled apart when the cleaning sponge 10 is put on the faucet and pull together, thus, securing the cleaning sponge 10 on the faucet or other bar, when the sponge is on the faucet. To remove the sponge from the faucet, the holding arms 13 and 15 are pulled apart and the cleaning sponge 10 is slid out from the faucet. Once the cleaning sponge is no longer on the faucet the holding arms 13 and 15 pull together and resume their original position.

Referring to FIGS. 1 through 7, the sponge 10 is shown to have a decorative border 16, which, in this particular embodiment, is depicted as a wave like line and may serve as a grasping measure when cleaning sponge 10 is used in cleansing various objects. The cleaning sponge 10 may be used in cleaning food dishes and utensils, such as forks, knives, spoons and other household kitchen utensils; also, the sponge 10 may be used in cleansing any household and non-household items which require dirt removal. The channel 30 and the cylindrical cavity 12 are cut through the edge 14 of the cleaning sponge 10, as shown in FIG. 3, where the holding arms 13 and 15 serve as gates mostly covering the cavity 12 and, thus, forming channel 30. The channel 30 and the cavity 12 are radially cut through the surface 14. The width of the channel 30 and the cylindrical cavity 12 is the width of the sponge, i.e., the distance between surface 26 and surface 28, as shown in FIG. 3.

The cavity 12 and the channel 30 are extending radially inward towards the center of the cleaning sponge 10. The channel 30 is approximately one quarter size of the cylindrical cavity 12 diameter. Since, the cleaning sponge is of a highly elastic material that is capable of returning to its original shape after it has been deformed, the channel 30 is able to be used for insertion of a faucet through the edge 14. Because of the size difference between channel 30 and cylindrical cavity 12, after the sponge is placed on the faucet, the narrowness of the channel 30 prevents the cleaning sponge 10 from sliding out. Moreover, when the cleaning sponge 10 is placed upon the faucet, the holding arms 13 and 15 serve as holding means and prevent the sponge from falling from the faucet. Due to elasticity of the cleaning sponge 10 and, thus, elasticity of the holding arms 13 and 15, the cleaning sponge 10 is easily placed on and removed from the faucet.

Referring to FIG. 7, the cleaning sponge 10 is shown being placed on the faucet 50. The holding arms 13 and 15 are securely holding the sponge on the faucet. When desired, the cleaning sponge 10 may be removed from the faucet. This produces an action by the two holding arms 13 and 15 in a direction A, as shown in FIG. 7. Once the sponge is removed, the holding arms return to their original positions by following the path of direction B. When the sponge is to be placed on the faucet 50, the same steps are repeated.

The sponge 10 is made out of an elastic material that is capable of being compressed and when the pressure is removed may return to its original form. Referring to FIGS. 2 and 3, the sponge is shown having a top surface 28 and a bottom surface 26. The top surface 28 is also a top surface for the top layer 20. The bottom surface 26 is also a bottom surface for layer 24. As shown in FIG. 2, the cleaning sponge 10 is shown to comprise three layers 20, 22, and 24. The top layer 20 has a greater coefficient of coarseness than the bottom layer 24. The layer 22 is an absorption layer between the top layer 20 and a bottom layer 24. The layer 22 serves also as a cushioning layer that allows the sponge 10 to clean variously shaped surfaces. When cleaning sponge 10 is in an application using layer 20, absorption layer 22 compresses allowing a closer contact of surface 28 and the surface of the object to be cleaned. A similar situation happens when layer 24 is used and the surface 26 is used to clean objects. The absorption layer 22 is made out of a material that is less dense and/or coarse than the top layer 20 and the bottom layer 24. Since, the absorption layer 22 is not used in direct cleaning application, there is no immediate need to make it as coarse or as dense as either of the two layers. Moreover, as shown in FIGS. 2 and 3, the top layer 20 is thinner than the bottom layer 24, thus allowing for bottom layer 24 to clean more gentle surfaces, whereas layer 20 may be used for surfaces requiring heavy cleaning due to its coarseness. The absorption/cushion layer 22 may serve as a moisture absorption layer by accumulating moisture when either of the layers 20 or 24 are used.

In another embodiment, the channel 30 and the cylindrical cavity 12 may be used to attach the cleaning sponge 10 to any hanging means, be it a faucet or any other object. The cavity 12 may be cut to any form, including a cylindrical shape cavity, a cube-shaped cavity or any other cavity that is desired. The channel 30 should be cut so that it is smaller that the overall width of the cavity 12.

Figure 5:
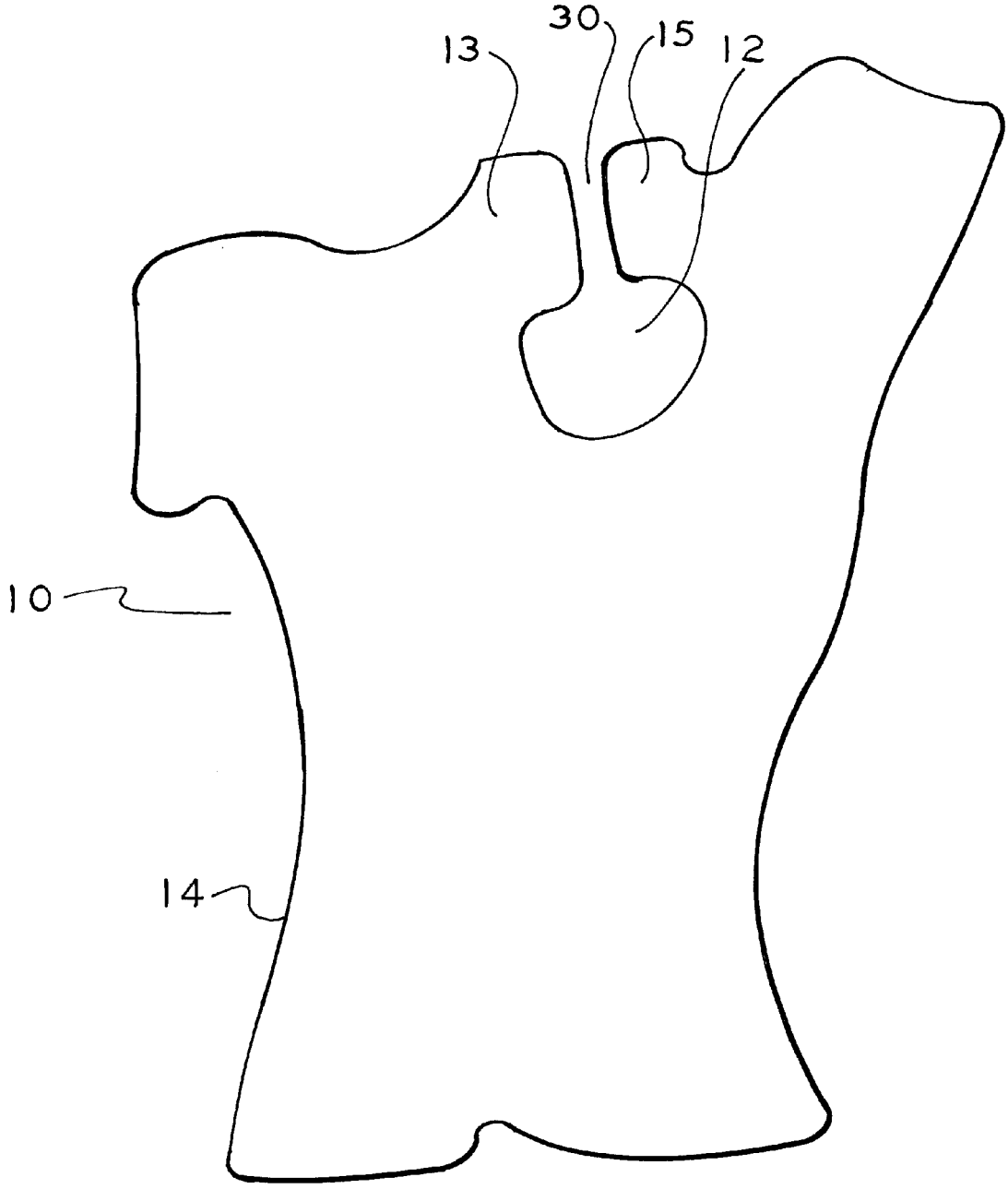
FIG. 5 is a plan view of the present invention in yet another embodiment.

Referring to FIGS. 4 through 6, the cleaning sponge 10 may have other embodiments. The cleaning sponge 10 is shown to have different shapes and sizes, however, retaining a three-layered structure and the faucet adjustable hanger port. The cleaning sponge 10 may be cut in any decorative way, as desired. The sponge may take a form of a fish, as shown in FIG. 6.

Furthermore, since, the cavity 12, holding arms 13 and 15, and the channel 30 are near one of the sides of the cleaning sponge 10, they do not interfere with the cleaning process and do not accumulate dirt in the cavity that causes dissatisfactory results. Finally, because of the unique location of the holding arms on the sponge, they will not break off while the sponge is used.

In the foregoing description, references to drawings and specific terms are used for descriptive purposes only and not to be construed as limiting the present invention to such. It is understood by one skilled in the art that the present invention is limited only to the prior art referenced above and the claims appended therein. The use of the drawings and specific terms is for the purposes of presentation, illustration and general comprehension only. Moreover, the drawings and the specific terms used are intended to be broadly construed and in no way limit the present invention.

It is, also, understood by one skilled in the art that other embodiments are possible as long as they are a reasonable interpretation of the appended claims and the disclosure above. Any and all changes or modifications to the present invention are feasible as long as they are within the scope and spirit of the appended claims.

What is claimed:

1. A cleaning sponge comprising:

a. A substantially planar sponge body including at least two distinct layers, a top surface, a bottom surface and a peripheral edge;

b. A cavity extending through the sponge body from the top to the bottom surface, said cavity being spaced from the peripheral edge of the sponge body;

c. A connection channel cut radially inward through the sponge body, from the peripheral edge to said cavity, said connection channel having a width less than that of said cavity; and d. Wherein said connection channel and said cavity form integral holding arms for hanging the sponge body onto an object and wherein said holding arms are substantially resilient in construction whereby they may move outwardly and inwardly to secure said sponge body onto a desired object.

2. A cleaning sponge of claim 1, wherein a top one of said layers has a greater coefficient of coarseness than a bottom one of said layers.

3. A cleaning sponge of claim 1, wherein said holding arms are elastic.

4. A cleaning sponge of claim 1, wherein said holding arms pull apart and pull together in opposite directions.

5. A cleaning sponge of claim 1, wherein said holding arms are pulled apart when said cleaning sponge is placed on a faucet and when said cleaning sponge is removed from a faucet.

6. A cleaning sponge of claim 1, wherein said holding arms are pulled together when said cleaning sponge is placed on a faucet and when said cleaning sponge is removed from a faucet.

7. A cleaning sponge of claim 1, wherein said cleaning sponge may be in any decorative form.

8. A cleaning sponge of claim 1, wherein said cleaning sponge is made of an elastic material capable of deforming from its original form when pressure is applied and restoring back to its original form when pressure is released.

9. A cleaning sponge of claim 1, wherein said cavity is in the form of a cylinder or cube.

10. A cleaning sponge of claim 1, wherein said cavity and said connection channel serve as a faucet adjustable device and said cavity and said connection channel is a hanger port.

11. A cleaning sponge of claim 1, wherein a bottom one of said layers is thicker than a top one of said layers.

12. A cleaning sponge comprising:

a. A substantially planar sponge body including at least three distinct layers including top layer, a middle layer, a bottom layer and further including a peripheral edge;

b. A cavity extending through the sponge body from the top layer to the bottom layer, said cavity being space from the peripheral edge of the sponge body;

c. A connection channel cut radially inward through the sponge body, from the peripheral edge to said cavity; and d. Wherein said connection channel and said cavity form integral holding arms for hanging the sponge body onto an object and wherein said holding arms are substantially resilient in construction whereby they may move outwardly and inwardly to secure said sponge body onto a desired object.

13. A cleaning sponge of claim 12, wherein said middle layer is located between said top layer and said bottom layer and wherein said middle layer serves as an absorption and cushion layer between said top layer and a surface to be cleaned and as an absorption and cushion layer between said bottom layer and a surface to be cleaned.

14. A cleaning sponge of claim 12, wherein the width of said connection channel is smaller than the radius of said cavity.

15. A cleaning sponge of claim 12, wherein said middle layer is an absorption layer for absorbing moisture from said top layer to said bottom layer.

16. A cleaning sponge of claim 12, wherein said middle layer is a cushioning layer providing elastic support when said cleaning sponge is used to clean a surface.

* * * * *